United States Patent [19]

Linsenbigler

[11] Patent Number: 5,025,956

[45] Date of Patent: Jun. 25, 1991

[54] SAFETY TOP SPRAYER

[76] Inventor: James G. Linsenbigler, 153 F Hague Blvd., Glenmont, N.Y. 12077

[21] Appl. No.: 255,952

[22] Filed: Oct. 11, 1988

[51] Int. Cl.[5] ..... B67B 5/00

[52] U.S. Cl. ..... 222/153; 222/321; 222/384

[58] Field of Search ..... 222/153, 382, 383, 384, 222/385, 320, 321, 372, 340, 341, 380

[56] References Cited

U.S. PATENT DOCUMENTS

| | | | |
|---|---|---|---|
| 2,861,839 | 11/1958 | Mellon | 222/321 |
| 3,180,534 | 4/1965 | Duda et al. | 222/321 |
| 3,229,863 | 1/1966 | Scoggin, Jr. et al. | 222/321 |
| 3,361,078 | 1/1968 | Cooprider | 222/383 |
| 3,940,023 | 2/1976 | Umstead | 222/321 |
| 4,065,036 | 12/1977 | Kirk, Jr. | 222/153 |
| 4,278,187 | 7/1981 | Luedtke | 222/321 |
| 4,503,996 | 3/1985 | Sorm et al. | 222/321 |
| 4,512,501 | 4/1985 | Foster | 222/153 |
| 4,516,695 | 5/1985 | Garneau | 222/153 |

*Primary Examiner*—Kevin P. Shaver

*Assistant Examiner*—Kenneth Noland

*Attorney, Agent, or Firm*—Leon Gilden

[57] ABSTRACT

A safety sprayer is set forth for use in combination with the spray dispensing of fluid within associated containers. A spray head is selectively locked in a first position and unlocked upon a 90 degree rotation of the spray head relative to an associated closure top. The spray head is vertically reciprocatable relative to an axially concentric and surrounding enclosure tube wherein the closure tube is permanently threaded to the top closure whereupon the enclosure tube must be rotated 90 degrees also relative to a cap threadedly engaging an associated storage container wherein the cap is provided with a plurality of diametrically opposed recesses accepting diagonally opposed flanges integrally associated and orthogonally disposed relative to the enclosure tube that are to be rotated out of the recesses to enable the enclosure tube to sealingly engage a plug seal associated with the mouth of the bottle to enable fluid to be directed from the bottle through the spray head during use.

9 Claims, 1 Drawing Sheet

SAFETY TOP SPRAYER

BACKGROUND OF THE INVENTION

1. Field of the Invention

The field of invention relates to spray heads, and more particularly pertains to a new and improved safety top sprayer utilizing a plurality of safety features to avoid misuse of the apparatus particularly by children and the like.

2. Description of the Prior Art

The use of spray heads and the like is well known in the prior art as their use in combination with fluid containers of various types to enable a dispensing of the fluid contents of the container by means of a spray or a stream. As may be understood, these devices are the subject of an on-going curiosity by children and the like with the attendant unwarranted and unsupervised dispensing of fluids from such containers. There have been attempts in the prior art to provide devices to thwart such unwarranted tampering, but such devices are generally of complex or ineffective configuration as opposed to the instant invention. For example, U.S. Pat. No. 3,940,023 to Umstead utilizes a clip-on security lock employing a lowermost portion securable to the base of a spray head in an aerosol container with a displaceable biased hinge to displace an uppermost portion from a first position to block the actuation of the spray head to a manually displaceable second position to enable depressing of the spray head to dispel contents from within the associated container. The Umstead patent is of interest but is typical of an easily manipulatable device absent of the plural locking and safety mechanisms of the instant invention.

U.S. Pat. No. 4,065,036 to Kirk sets forth a spray actuator assembly wherein the cap utilizes a series of flats with an underlying dispensing button where the dispensing button includes a series of flats with a series of tabs thereon. A cover piece enclosing the button exposes a portion of the button for finger engagement in a guide slot and the cover button prevents relative movement between the button and the cover. The associated flats of the cap and dispensing button maintain alignment of the items. The device is of interest relative to effecting a directional displacement of spray, but fails to provide the plural safety mechanisms as evidenced by the use of the instant invention.

U.S. Pat. No. 4,512,501 to Foster sets forth a reciprocatable dispensing plunger utilizing reciprocatably displaceable head and lower portion to disengage the two and enable dispensing of contents from within the container.

U.S. Pat. No. 4,516,695 to Garneau provides a child-resistant nozzle in combination with a sprayer utilizing an on/off position as well as a sprayer stream position to selectively effect and attempt to prevent unwarranted discharge of contents of an associated container.

U.S. Pat. No. 4,582,228 to Diamond sets forth a safety type sprayer wherein a safety device is permitted between a spraying and non-spraying position of the head providing a blocking and releasing position relative to the actuator head to prevent or permit displacement of fluid from the container.

U.S. Pat. No. 4,589,574 to Foster provides a plurality of serrations on an upper end of a pump body for enabling displacement of the discharge head from a plurality of positions to permit a locking or unlocking of the spray head to enable discharge of fluid through the spray head.

As such, it may be appreciated that there is a continuing need for a new and improved safety top sprayer that utilizes a plurality of positions to prevent unwarranted discharge of contents from within a container and to this end, the instant invention substantially fulfills this need effecting not only a locking of a spray head relative to an enclosure to prevent reciprocation of the tube, but furthermore provides a locking and unlocking of the tube to selectively effect a continuous or discontinuous conduit from the container's interior to the spray head.

SUMMARY OF THE INVENTION

In view of the foregoing disadvantages inherent in the known types of safety sprayers now present in the prior art, the present invention provides a safety top sprayer wherein the same provides a plurality of independent safety measures associated with the sprayer to thwart unwarranted discharge of fluid contents associated with the sprayer. As such, the general purpose of the present invention, which will be described subsequently in greater detail, is to provide a new and improved safety top sprays which has all the advantages of the prior art safety sprayers and none of the disadvantages.

To attain this, the present invention comprises a plurality of axially aligned members axially aligned and associated with a fluid container wherein a spray head is threadedly engageable and disengageable with an associated top closure at an upper portion of the top closure with an enclosure tube threadedly secured to a lowermost portion of the top closure wherein the spray head is disengageable with the top closure upon 90 degree rotation of the spray head and disengagement of threads within the spray head with an interrupted thread with the top closure. The enclosure tube is axially coincident with the axis of the spray head and provided with a plurality of diametrically opposed flanges whereupon the enclosure tube is positioned in a first position to provide a discontinuous association of a fluid conduit associated with the bottle's contents whereupon rotation of the enclosure tube effects a sealing relationship with a plug seal positioned within the mouth of the associated container. The enclosure tube further includes a biasing means to maintain the enclosure tube in the first position wherein the spray head further includes biasing means and a check ball member to assist in the discharging of fluid through the spray head.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety top sprayer which has all the advantages of the prior art safety top sprayers and none of the disadvantages.

It is another object of the present invention to provide a new and improved safety top sprayer which may be easily and efficiently manufactured and marketed.

It is a further object of the present invention to provide a new and improved safety top sprayer which is of a durable and reliable construction.

An even further object of the present invention is to provide a new and improved safety top sprayer which is susceptible of a low cost of manufacture with regard to both materials and labor, and which accordingly is then susceptible of low prices of sale to the consuming public, thereby making such safety top sprayers economically available to the buying public.

Still yet another object of the present invention is to provide a new and improved safety top sprayer which provides in the apparatuses and methods of the prior art some of the advantages thereof, while simultaneously overcoming some of the disadvantages normally associated therewith.

Still another object of the present invention is to provide a new and improved safety top sprayer provided with a plurality of mechanical interrelationships to effect a plurality of safety devices to prevent unwarranted discharge of fluid through the sprayer head associated with the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
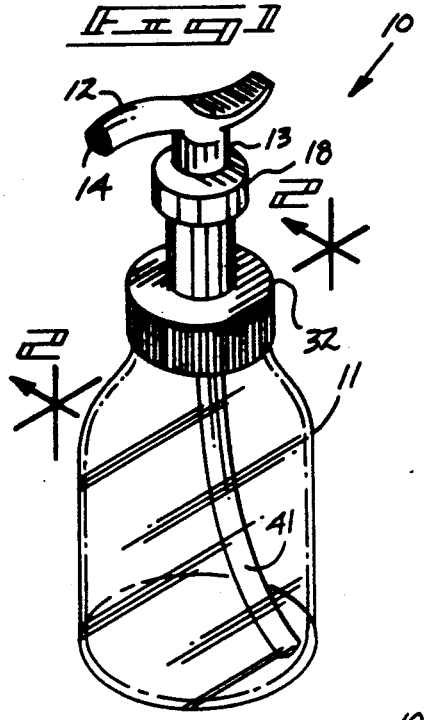
FIG. 1 is an isometric illustration of the instant invention associated with a container.

With reference now to the drawings, and in particular to FIGS. 1 to 4 thereof, a new and improved safety top sprayer embodying the principles and concepts of the present invention and generally designated by the reference numeral 10 will be described.

More specifically, it will be noted that the safety top sprayer 10 of the instant invention comprises the sprayer assembly 10 fixedly secured to an associated container 11. Association may be effected through a threaded or crimped-on relationship.

The sprayer 10 further includes a horizontally disposed spray head 12 formed with an upper surface to accept manually directed force thereon with an orthogonally formed tubular body 13. The spray head 12 is formed with a first spray head conduit 14 formed through the spray head and axially of the tubular body 13 directed downwardly and terminating into a second spray head conduit 15 of an enlarged diametrical configuration relative to the first spray head conduit 14 to form an enlarged cavity therein.

Figure 4:
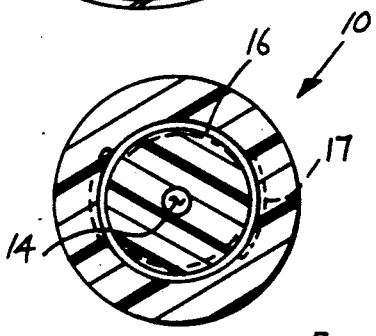
FIG. 4 is an orthographic view taken along the lines 4—4 of FIG. 2 in the direction indicated by the arrows.

The spray head 12 is secured to a first cap 18 by a threaded interconnection utilizing diametrically opposed portions of interrupted threads 16 formed on the exterior surface of the tubular body 13 to cooperate with diametrically opposed portions of interrupted threads 17 of the cap 18. A 90 degree rotation of the tubular body 13 relative to the first cap 18 will engage or disengage the relationship of the threads 16 and 17 wherein FIG. 4 illustrates the disassociated engagement of the two threads to enable the tubular body 13 to reciprocate relative to the cap 18 and an associated enclosure tube 22.

The first cap 18 is formed with a second enlarged axially aligned cavity 19 positioned underlying the upper axial opening accepting the tubular body 13 therethrough wherein a continuous cap thread 20 is formed on the interior wall of the cavity 19 to cooperate with the threads 21 of the enclosure tube 22. The enclosure tube 22 is formed with integrally and diametrically projecting flanges 23 formed of a diameter equal to the internal cavity diameter of a second cap 32. Finally the enclosure tube 22 is formed with an inwardly tapered constricted lower end 24 defining an enclosure port 25 axially thereof to define a communicating port to cooperate with the first and second spray head conduits 14 and 15.

A plunger spring 26 of a coil configuration is positioned within the second conduit 15 and abuts the shoulder defined between the respective conduits 14 and 15 at its upper end and is maintained in position by exterior perimeter seat 28 of spring follower 27 where the perimeter seat is perpendicularly positioned relative to the vertical cylindrical walls 29 of the spring follower 27. The perimeter seat 28 projects radially inwardly to define inwardly extending seat **28*a*, also formed perpendicular to the cylindrical walls 29 of the follower 27. The inwardly extending seat 28*a* is formed with an underlying central seat 30 overlying a check ball 26 captured between the seat 30 and the axially aligned lower end 24 of the enclosure tube 22**.

Figure 2:
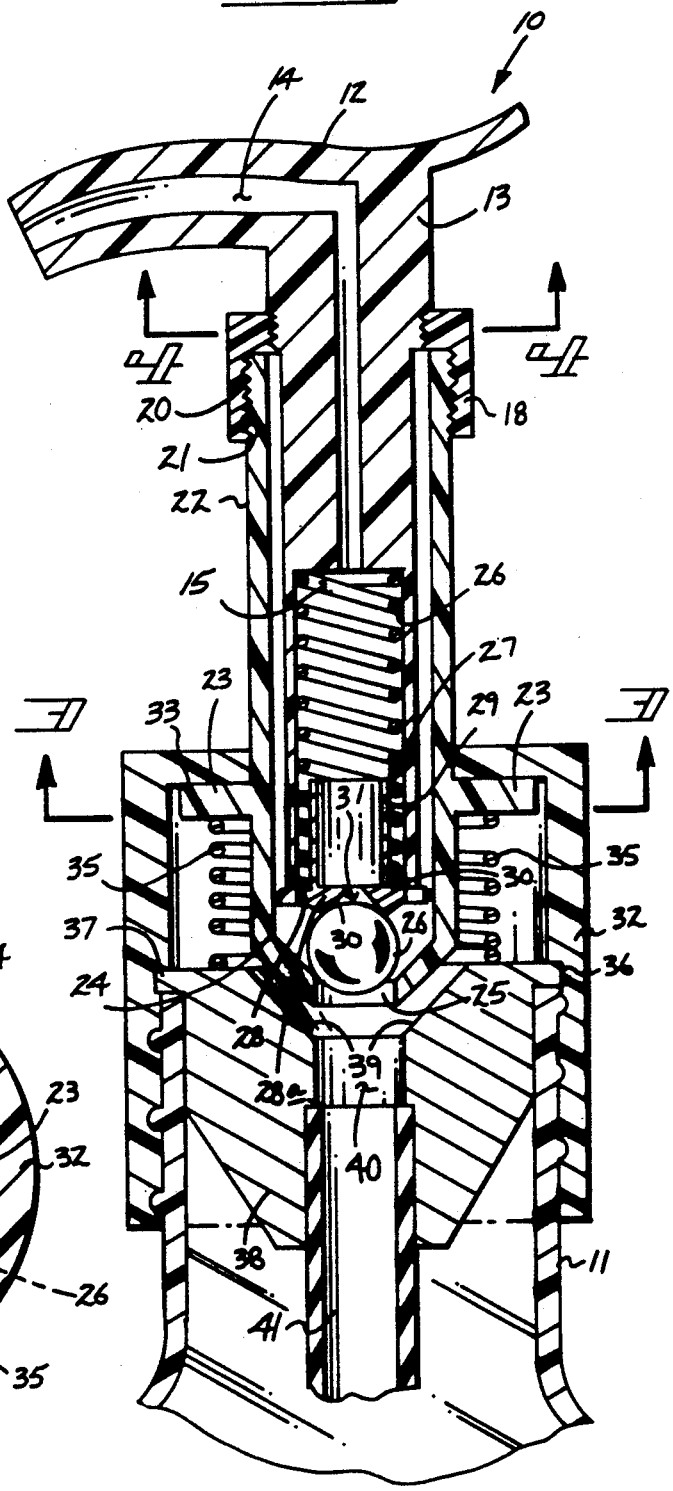
FIG. 2 is an orthographic view taken taken along the lines 2—2 of FIG. 1 in the direction indicated by the arrows.
Figure 3:
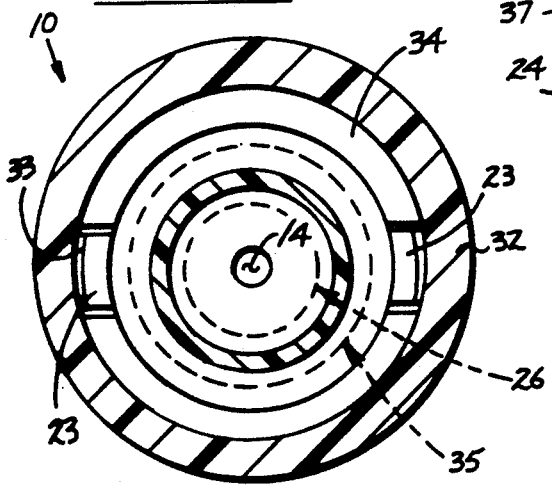
FIG. 3 is an orthographic view taken along the lines 3—3 of FIG. 2 in the direction indicated by the arrows.

The second cap 32 is formed of a cylindrical configuration formed with a central bore to accept the enclosure tube 22 wherein an interior horizontal surface of the cap 32 is formed with diametrically opposed recesses 33 to accept the enclosure tube flanges 23 therewithin, as illustrated in FIG. 3 for example. The recesses 33 are formed beyond the second cap 32's interior floor 34 formed generally perpendicular of the side walls of the second cap 32. Further the second cap 32 is formed with a circumferential notch 36 formed on interior side wall of the second cap 32, as illustrated in FIG. 2, to accept a circumferential flange 37 diametrically formed outwardly of a plug seal 38 that is formed with an external diameter substantially equal to that of the internal diameter of the container bottle 11's mouth. The plug seal 38 is formed with an upper cavity 39 of complementary configuration to the tapered constricted lower end 24 of the enclosure tube 22 to accept the tube's lower end 24 sealingly therewithin and axially align with the plug's central conduit 40 accepting the pickup tube 41 therewithin. To disengage the spray head from the first cap 18, an individual merely grasps the first cap 18 and rotates the spray head 12 ninety degrees relative thereto, as illustrated in FIG. 4, to disengage the respective threads 16 and 17 to enable the spray head to reciprocate vertically relative the enclosure tube 22. Further, the enclosure tube 22 must be depressed downwardly against a second spring 35 captured between the enclosure tube flanges 23 and the top surface of the plug seal 38 whereupon the flanges 23 are withdrawn from within the recesses 33 of the second cap 32 and upon rotation of the closure tube, the flanges 23 will thereafter rest upon the interior floor 34 of the second cap 32. It is noted that the depth of the recesses 33 are substantially equal to the spacing between the constricted lower end 24 and the upper cavity 39 of the plug seal whereupon positioning of the flanges 23 onto the interior floor 34, a sealing relationship exists between the cavity 39 and the constricted lower end 24 of the enclosure tube 22 whereupon reciprocation of the spray 12 effects fluid discharge through the pickup tube 41, the central plug conduit 40, through the check ball 26, and the associated enclosure port 25 formed through the constricted lower end 24 of the enclosure tube 22. Thereafter fluid will be projected upwardly centrally through the spring follower 27, the second spray head condiut 15 and outwardly of the spray head 12 through the first spray head conduit 14. It is noted that the vertical leg of the spray head conduit 14 is axially aligned with the second spray head conduit 15, the interior cavity of the spring follower 27, the enclosure port 25, the upper cavity 39 of the plug seal 38, the central plug conduit 40 and the pickup tube 41.

The manner of usage and operation of the instant invention therefore should be apparent from the above description and accordingly no further discussion relative to the manner of usage and operation shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety top sprayer for use in combination with a fluid container comprising, a manually reciprocatable spray head including a through-extending conduit formed to an orthogonally oriented tubular body formed with a second conduit wherein said first conduit and said second conduit are of a first diameter, and said first cap including an upper diametrically opening formed with first selective securement means to cooperate with a second selective securement means on an exterior surface of said tubular body for selective engagement of said tubular body to said first diametrical opening, and said cap formed with a second opening underlying said first opening for securement of a downwardly depending enclosure tube axially aligned with and in surrounding relationship to said tubular body underlying said first diametrical opening, and a third conduit of a second diameter formed in said tubular body wherein said second conduit is directed into said third conduit, and a first spring captured in said third conduit between a step defined by the second conduit opening into said third conduit, and a spring follower formed on a further terminal end of said spring, and a check ball captured between said spring follower at a lower terminal end of said enclosure tube, and at least one flange directed orthogonally and secured to said enclosure tube selectively nestable within a recess formed on an interior horizontal surface of a second cap wherein said second cap accepts said enclosure tube therethrough to cooperate with a plug seal positionable within a mouth of said container to direct said fluid through said spray head from said container, and wherein said first selective securement means and said second selective securement means comprise interrupted threads wherein said first selective securement means comprises two sections of interrupted thread diametrically opposed comprising substantially 90 degrees of arc about said upper diametrical opening, and said second selective securement means comprises a plurality of interrupted thread portions diametrically opposed and formed on substantially 90 degrees of arch about exterior surface of said tubular body.

2. A safety top sprayer as set forth in claim 1 wherein said lower terminal end of said enclosure tube is spaced in a first position from a complementary cavity formed in an upper surface of said plug seal, and said lower terminal end positioned in contiguous relationship with said cavity of said plug seal when said at least one flange is rotatably withdrawn from said recess formed within said second cap.

3. A safety top sprayer as set forth in claim 2 wherein said spring follower includes a cylindrical upper portion terminating in a lower exterior flange for securement of said spring and further formed with an inwardly directed flange formed with a central axial opening to receive said check ball.

4. A safety top sprayer as set forth in claim 3 wherein a second spring is captured between said plug seal and said at least one flange.

5. A safety top sprayer as set forth in calim 4 wherein said enclosure tube includes a plurality of diametrically opposed flanges nestable within diametrically opposed recesses formed within said second cap interior surface.

6. A safety top sprayer as set forth in claim 5 wherein said plug seal includes a bore terminating in a shoulder to accept a pickup tube therein.

7. a safety top sprayer as set forth in claim 6 wherein said plug seal includes a circumferential flange formed projecting outwardly and orthogonally relative to side walls of said plug seal wherein said flange is positionable within circumferential and complementary shaped notch formed within a downwardly depending side wall of said cap orthogonally formed to said horizontal interior surface.

8. A safety top sprayer as set forth in claim 7 wherein said enclosure tube is threadedly secured to said first cap within said second opening wherein said second opening is of a diametrically enlarged configuration relative to said first opening.

9. A safety top sprayer as set forth in claim 8 wherein said second conduit, said third conduit, said spring follower, said plug seal, said first cap, and said second cap are axially aligned relative to one another.

* * * * *